US005864957A

United States Patent [19]

Small

[11] Patent Number: 5,864,957

[45] Date of Patent: Feb. 2, 1999

[54] UNIVERSAL SIGHT TOOL

[76] Inventor: Bernard Small, 8800 Verree Rd., Philadelphia, Pa. 19115

[21] Appl. No.: 998,563

[22] Filed: Dec. 29, 1997

[51] Int. Cl.[6] ..... F41G 1/44

[52] U.S. Cl. ..... 33/233; 42/100

[58] Field of Search ..... 42/100, 103, 90; 33/233, 252

[56] References Cited

U.S. PATENT DOCUMENTS

| | | | |
|---|---|---|---|
| 2,425,713 | 8/1947 | Applegate | 33/233 |
| 2,599,839 | 6/1952 | Keifer | 33/252 |
| 4,669,193 | 6/1987 | Moore | 33/233 |
| 5,222,302 | 6/1993 | DeBatty et al. | 33/233 |
| 5,388,335 | 2/1995 | Jung | 33/252 |
| 5,442,860 | 8/1995 | Palmer | 33/233 |
| 5,737,866 | 4/1998 | Minaire et al. | 42/90 |

*Primary Examiner*—Charles T. Jordan
*Assistant Examiner*—Denise J. Buckley
*Attorney, Agent, or Firm*—Zachary T. Wobensmith, III

[57] ABSTRACT

A universal sight tool for use with pistol slides to remove, install, and adjust the front and/or rear sights which are carried in a dovetail in the slide. The tool is also useful to drill and tap barrels and receivers for sights, beads and scope mounts. The tool includes a frame mounted to a stand, an adjustable sight carriage to engage a sight to be adjusted, a slide leveler/barrel support, a floor plate, fixed and mobile jaws to engage and retain the slide, and bushings on top of the frame to guide drills and taps for drilling and tapping of barrels and receivers.

9 Claims, 3 Drawing Sheets

UNIVERSAL SIGHT TOOL

BACKGROUND OF THE INVENTION

1. Field of the Invention

This invention relates to a universal sight tool for removing installing and adjusting dovetailed sights on pistol slides, of the type which clamps the slide, with a movable carriage to engage and manipulate the sight.

2. Description of the Prior Art

The removal, installation or adjustment of sights carried in a pistol slide is often a difficult task.

Many pistol slides such as used on a Colt .45 automatic pistol or a Glock pistol have front or rear sights which are set in a dovetail in the slide, which sights are adjusted at the factory and the dovetail is peened to retain the sight in place. Many shooters seek to use better sights than are supplied at the factory, or wish to adjust the front or rear sight to compensate for changes in the barrel and/or to obtain a greater degree of accuracy.

A common method of changing and adjusting sights is to mount the pistol slide in a vise, and use a steel punch to strike the sight and change its location in the dovetail, or to remove it all together so that a new sight may be installed. This method of sight adjustment or removal is crude, often damages or destroys the sight and/or dovetail, and does not lend itself to the degree of accuracy required by the user.

The universal sight tool of the invention permits of fine adjustment of a sight, provides fast removal of an old sight and installation of a new one, does not damage the sight or the slide, and includes provisions for drilling and tapping of receivers or barrels for installation of scope mounts, sights and beads.

SUMMARY OF THE INVENTION

This invention relates to a universal sight tool for removing, installing or adjusting sights on pistol slides, which tool includes a body mounted to a stand, an adjustable carriage to engage the sights, an adjustable slide leveler, a floor plate, fixed and mobile jaws to engage and retain the slide, and provisions for drilling and tapping barrels and receivers for scope mounts, sights and beads.

The principal object of the invention is to provide a universal sight tool for removing, installing and adjusting sights, which are engaged in dovetails in pistol slides.

A further object of the invention is to provide a universal sight tool that does not damage the sight or the slide.

A further object of the invention is to provide a universal sight tool that is useful with a wide variety of sights and pistol slides.

A further object of the invention is to provide a universal sight tool that is easy to use.

A further object of the invention is to provide a universal sight tool that can be used to drill and tap barrels and receivers for scope mounts, sights and beads.

A further object of the invention is to provide a universal sight tool that is consistent in operation.

A further object of the invention is to provide a universal sight tool that is sturdy and reliable in operation.

A further object of the invention is to provide a universal sight tool that is simple and inexpensive to construct.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

It should, of course, be understood that the description and drawings herein are merely illustrative and that various modifications and changes can be in the structures disclosed without departing from the spirit of the invention.

Like numerals refer to like parts throughout the several views.

DESCRIPTION OF THE PREFERRED EMBODIMENTS

When referring to the preferred embodiments, certain terminology will be utilized for the sake of clarity. Use of such terminology is intended to encompass not only the described embodiment, but also technical equivalents which operate and function in substantially the same way to bring about the same result.

Referring now more particularly to FIGS. 1–4 of the drawings, one embodiment of the universal sight tool 10 is therein illustrated.

The tool 10 includes a stand 11 which has a top plate 12, with side plates 14 and 15 extending therefrom, which are intended to rest on a supporting surface, which may be a work bench or table (not shown).

The stand 11 is preferably constructed of aluminum, which may have a finish of black satin teflon.

Figure 1:
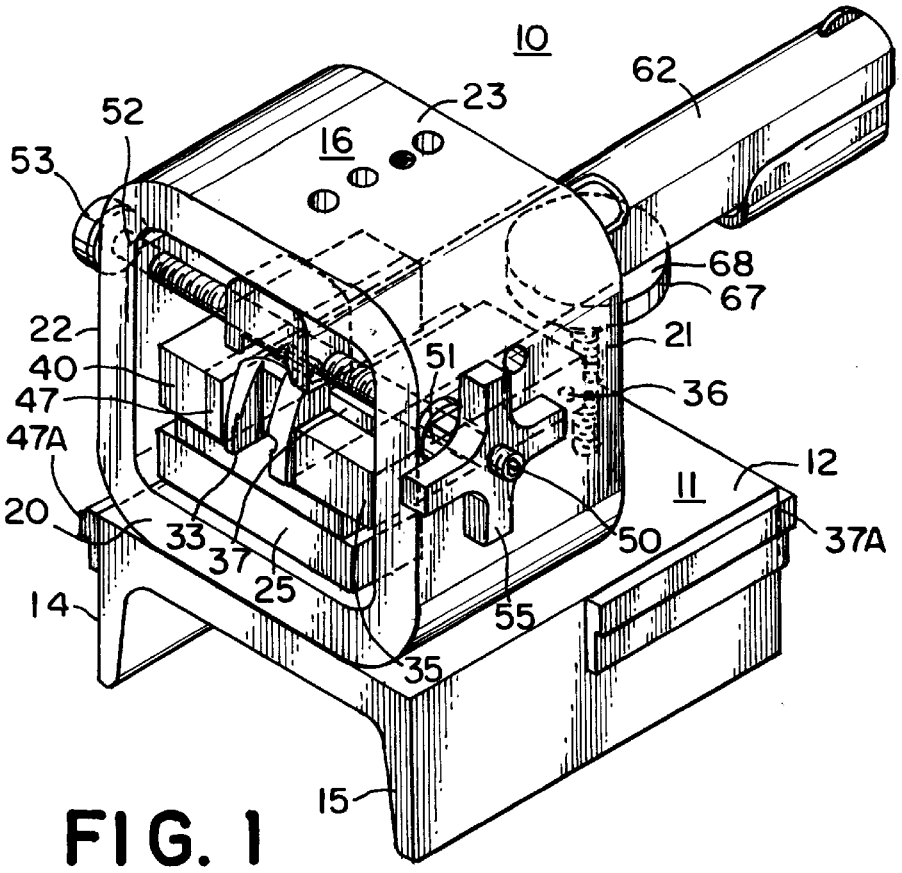
FIG. 1 is a view in perspective of one embodiment of the universal sight tool of the invention, with a pistol slide shown in place for sight work.
Figure 2:
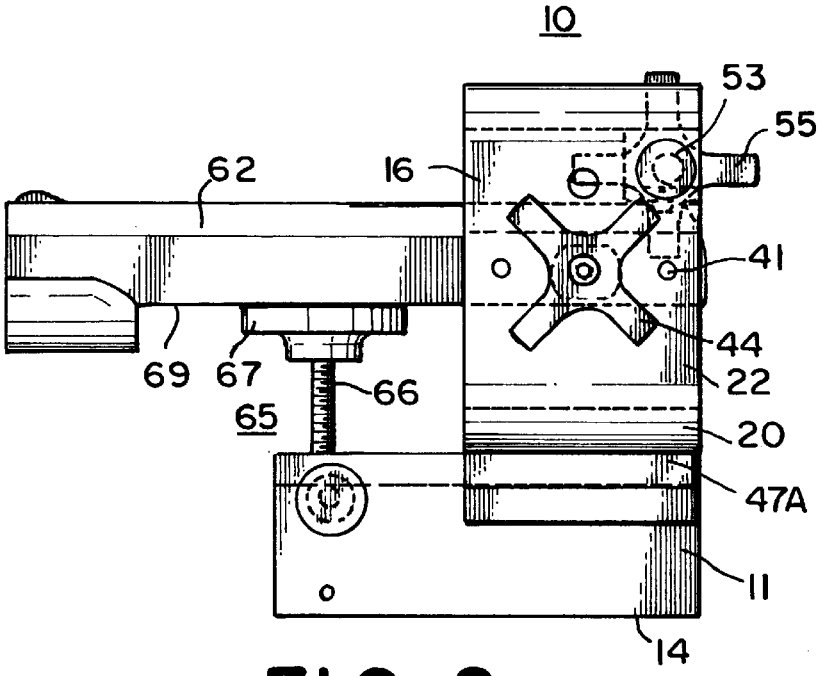
FIG. 2 is a left side elevational view of the sight tool of FIG. 1.
Figure 3:
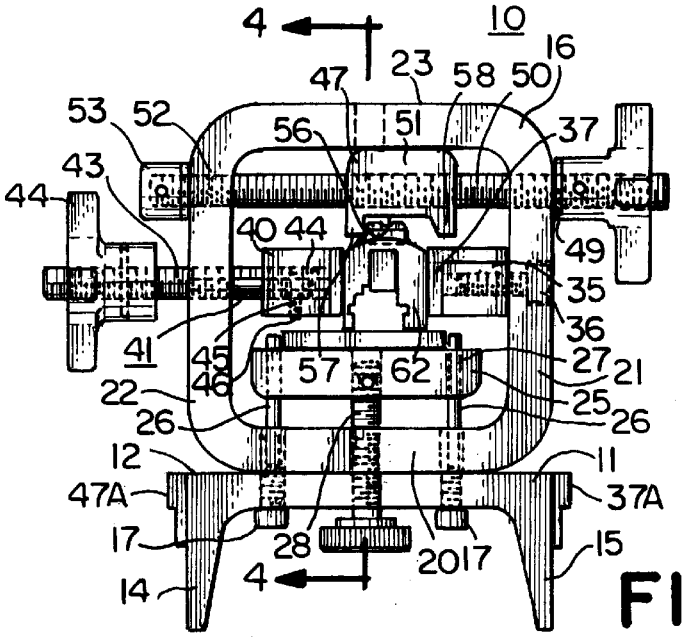
FIG. 3 is a front elevational view of the sight tool of FIG. 1.
Figure 4:
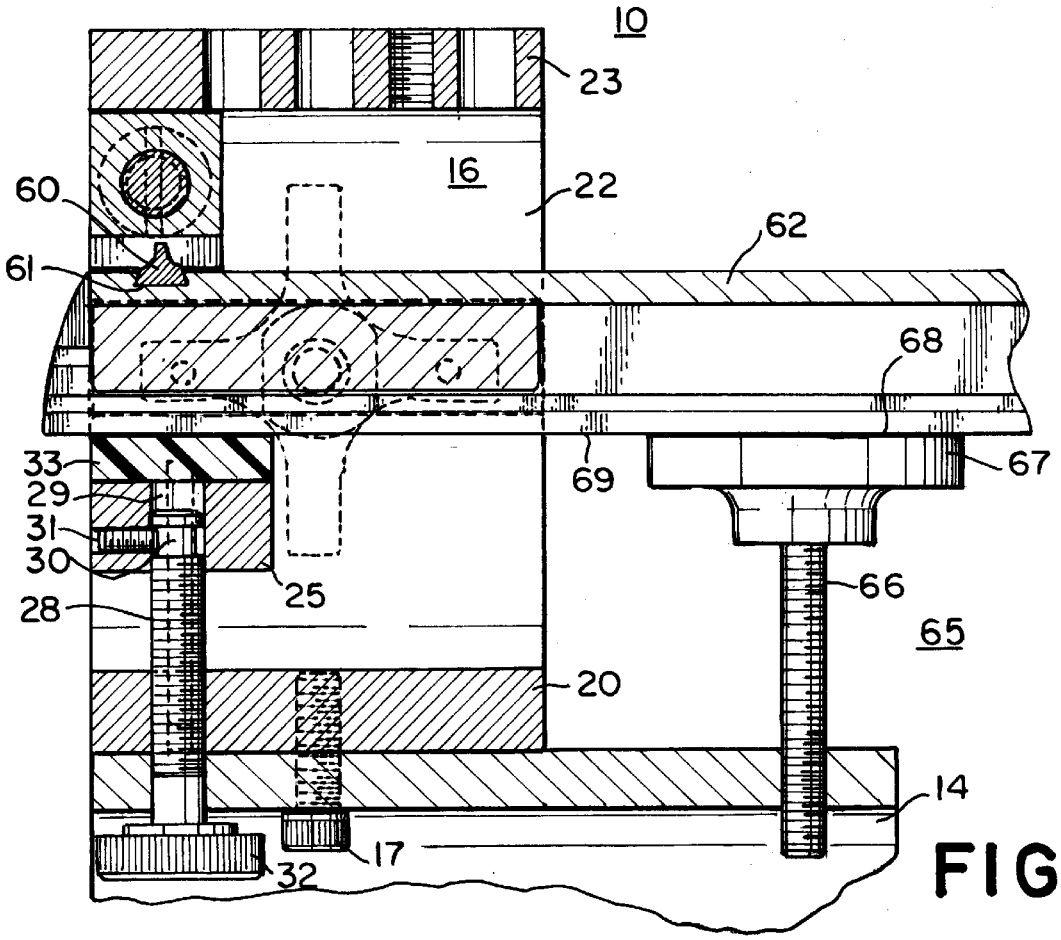
FIG. 4 is a vertical sectional view, enlarged, taken approximately on the Line 4–4 of FIG. 3.

A frame 16 is provided, of square configuration as seen in FIG. 1, which is mounted to top plate 12 of stand 11 by two cap screws 17. The frame 16 has a bottom wall 20, sidewalls 21 and 22 and top wall 23. The walls 20, 21, 22, and 23 in the described embodiment are each preferably constructed of steel of a length of four (4 ) inches, a width of two and one-half (2½) inches, and a thickness of one-half (½) inch.

The frame 16 may have a finish of black satin teflon.

A floor plate 25 is provided, preferably of aluminum which may have a black satin teflon finish, which is mounted on two pins 26 which are engaged in bottom wall 20 of frame 16, and in holes 27 in plate 25 permitting vertical movement. A floor plate shaft 28 is provided, threadably engaged in bottom wall 20, and carried in opening 29 in floor plate 25, with a groove 30 in shaft 28 which is engaged by a set screw 31 in plate 25, which restrains the shaft from vertical movement in plate 25, so that upon the shaft's rotation the plate 25 is raised or lowered on pins 26.

The shaft 28 is provided with a knob 32 affixed to its bottom end for rotation of the shaft.

The floor plate 25 has a floor plate riser 33 thereon, which riser is preferably constructed of Delrin plastic, and secured to plate 25 by two pins (not shown) which extend into the floor plate 25.

The side wall 21 of frame 16 above plate riser 33, has a stationary jaw 35 attached thereto by two cap screws 36, with a side plate 37 detachably attached thereto by pins (not shown), which extend into jaw 35.

The side plate 37 is preferably formed of Delrin plastic.

The side plate 22 of frame 16 above riser plate 33, has a mobile jaw 40 mounted on two pins 41, which are retained in plate 22 and engaged in openings (not shown) in jaw 40 permitting horizontal movement. A mobile jaw shaft 43 is provided threadably engaged in plate 22, with a knob 44 affixed thereto for rotation thereof, and extends into an opening 44 in jaw 40, with a groove 45 in shaft 43 engaged by a set screw 46 in jaw 40, whereby jaw 40 is moved along pins 41.

The mobile jaw 40 is also provided with a mobile jaw side plate 47, which is preferably constructed of Delrin plastic, and detachably attached to the jaw 40 by two pins 48 engaged therewith.

The side wall 21 above stationary jaw 35 has a bearing 49 therein, which carries a transversely extending sight carriage shaft 50, which is threadably engaged with a sight carriage 51, with the shaft 50 also carried in a bearing 52 in sidewall 22, with a collar 53 affixed thereto. A knob 55 is affixed to shaft 50 outside of bearing 49, for rotation of shaft 50 and movement of sight carriage 51 between side walls 21 and 22. The sight carriage 51 is a block of rectangular configuration, with a bottom wall 56 and vertically extending walls 57 and 58 to engage a sight 60, which is retained in a dovetail 61 of a slide 62, to be described.

The stand 11 in rear of frame 16 is provided with a slide leveler/barrel support 65, which includes a threaded shaft 66 engaged in the top plate 12, and a leveling knob 67 affixed to the shaft 66, with a flat surface 68 to engage the bottom 69 of slide 62. The knob 67 is preferably formed of plastic. An additional pair of jaw side plates 37 A and 47 A are provided which are carried by stand side plates 14 and 15 and are of different configuration than jaw side plates 37 and 47 to accommodate pistol slides which have slide mounted safeties.

The mode of operation will now be pointed out.

A slide 62 which is illustrated as a Colt .45 pistol slide, is placed on top of levelling knob 67, and on top of floor plate riser plate 33.

The mobile jaw 40 is moved towards slide 62 until it's side plate 47 is against the slide 62, and slide plate 37 is touching the other side of slide 62.

The floor plate riser 33 is adjusted by rotating shaft 28 until the top of sight 60 barely touches bottom wall 56 of sight carriage 51.

The levelling knob 67 is adjusted to level the slide 62, and the mobile jaw 40 is tightened against the slide.

The sight carriage knob 55 is rotated to move the sight carriage 51 against sight 60 in dovetail 61 in the desired direction for adjustment, or removal and installation of a new sight.

The side wall 22 is also provided with an opening 75, which permits a punch (not shown) to be inserted and to drive sight 60 out of dovetail 61, which opening is in front of sight carriage 51, with the sight 60 also in front of sight carriage 51 for removal.

Figure 5:
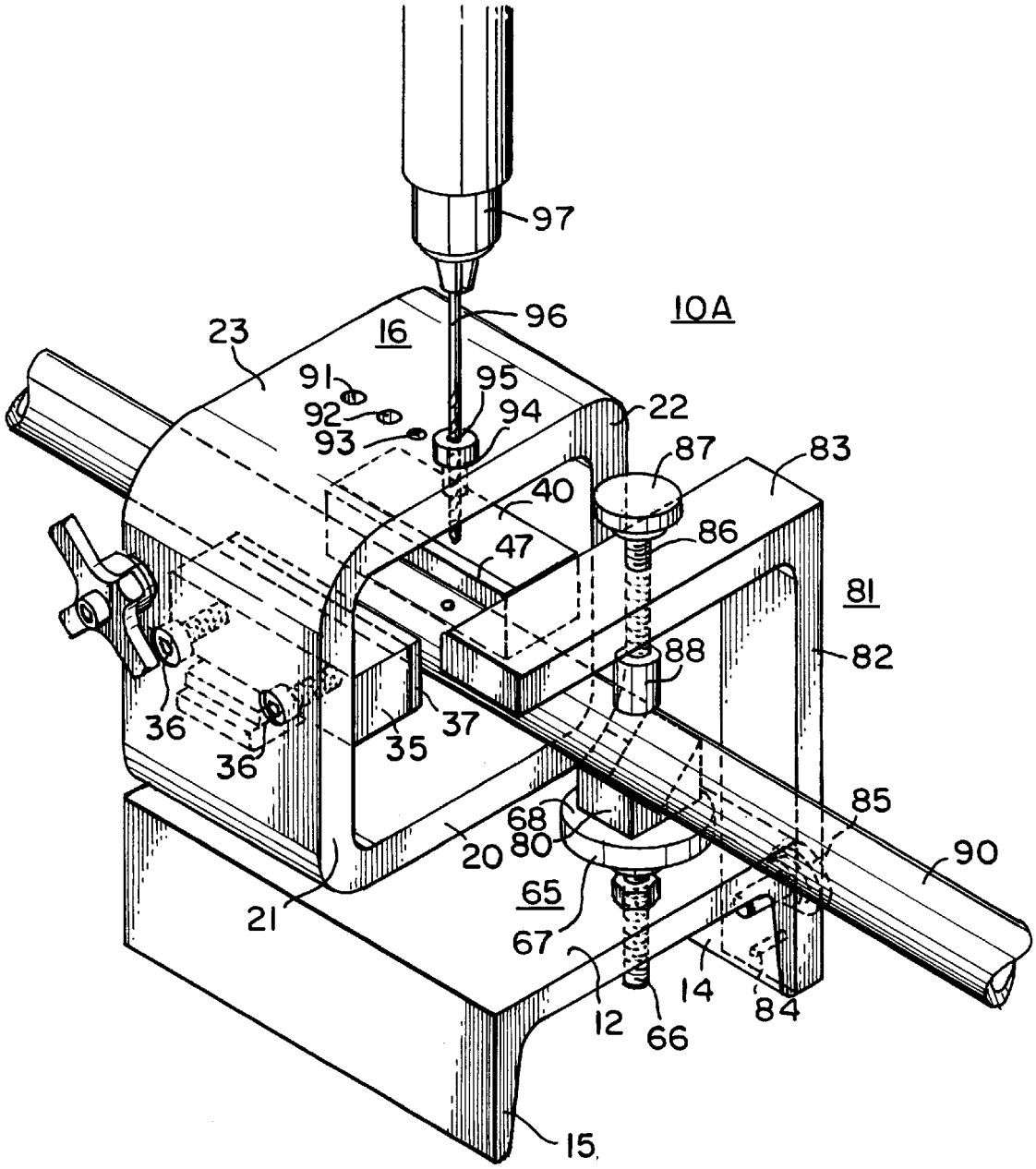
FIG. 5 is a perspective view of another embodiment of the universal sight tool of the invention, illustrating the drilling of a barrel for sight or scope mount attachment.

Referring now to FIG. 5 another embodiment of the tool 10 A is illustrated, which includes a stand 11 which as a top plate 12, with side plates 14 and 15 extending therefrom, which are intended to rest on a supporting surface, which may be a work bench or table (not shown).

The stand 11 is preferably constructed of aluminum, which has a finish of black satin teflon.

A frame 16 is provided, of square configuration, which is mounted to top plate 12 of stand 11 by two cap screws (not shown). The frame 16 has a bottom wall 20, sidewalls 21 and 22, and top wall 23. The walls 20, 21, 22, and 23 in the described embodiment are preferably constructed of steel each of a length of four (4)) inches, a width of two and one-half (2½) inches, and a thickness of one-half (½) inch.

The frame 16 has a finish of black satin teflon.

A floor plate (not shown is provided, preferably of aluminum with a black satin teflon finish, which is mounted on two pins (not shown), which are engaged in bottom wall 20 of frame 16, and in holes (not shown) in the floor plate (not shown) permitting vertical movement. A floor plate shaft, (not shown) is provided, threadably engaged in bottom wall 20, and carried in opening (not shown) in the floor plate, (not shown), with a groove (not shown), in the floor plate shaft, which is engaged by a set screw (not shown) in the floor plate so that upon the shaft's rotation the floor plate is raised or lowered on its pins.

The floor plate shaft is provided with a knob (not shown) affixed to its bottom end for rotation of the shaft.

The floor plate has a floor plate riser (not shown) thereon, which riser is preferably constructed of Delrin plastic, and secured to the floor plate by two pins (not shown) which extend into the floor plate 25.

The side wall 21 of frame 16 above plate riser 33, has a stationary jaw 35 attached thereto by two cap screws 36, with a side plate 37 detachably attached thereto by pins (not shown), which extend into jaw 35.

The side plate 37 is preferably formed of Delrin plastic.

The side plate 22 of frame 16 above riser plate 33, has a mobile jaw 40 mounted on two pins (not shown), which are retained in plate 22 and engaged in openings (not shown) in jaw 40 permitting horizontal movement. A mobile jaw shaft (not shown) is provided threadably engaged in plate 22, with a knob (not shown) affixed thereto for rotation thereof, and extends into an opening (not shown) in jaw 40, with a groove (not shown) in the mobile jaw shaft engaged by a set screw (not shown) in jaw 40, whereby jaw 40 is moved along its pins.

The mobile jaw 40 is also provided with a mobile jaw side plate 47, which is preferably constructed of Delrin plastic, and detachably attached to the jaw 40 by two pins (not shown) engaged therewith.

The stand 11 in rear of frame 16 is provided with a slide leveler 65, which includes a threaded shaft 66 engaged in the top plate 12, and a slide leveling knob 67 affixed to the shaft 66, with a flat surface 68 to engage a barrel support V-block 80. The knob 67 is preferably formed of plastic.

A clamp arm 81 is provided, of L-shape and preferably formed of aluminum with a black satin teflon finish.

The clamp arm 81 which includes side walls 82 and top wall 83, is attached to side plate 15 of stand 11 by a pin 84 and a bolt 85 in wall 82. The clamp arm 81 has a shaft 86 threadably engaged in top wall 83, with a knob 87 affixed thereto, and a tip 88 rotatably attached at the end opposite to knob 85.

The shaft 86 is preferably of steel and the tip 88 is preferably of Delrin plastic.

A barrel 90 is shown in place in the V-block 80 with tip 88 retaining it therein, with the barrel 90 held between side plates 37 and 47, and on floor plate riser (not shown).

If required, a remote barrel support (not shown) may be provided to provide extra support to the barrel 90.

The top wall 23 of frame 16 is provided with a plurality of holes 91, 92, 93 and 94, which may have drilling and tapping bushings of well known type engaged therewith for drilling and tapping operations on slides, receivers or barrels.

As shown in FIG. 5, a drilling bushing 95 is provided in hole 94 with a drill bit 96 therein, which is held in a drill chuck 97, which extends from a drill press (not shown) of well known type.

It will thus be seen that apparatus has been provided with which the objects of the invention are achieved.

I claim:

1. A universal sight tool for use with pistol slides to adjust, remove, or install at least one sight which sight is carried in at least one dovetail in the slide which comprises a stand to be placed on a supporting surface;

said stand has a top plate with side plates extending therefrom to engage said supporting surface;

a frame having a bottom wall, a top wall and side walls connecting said top and bottom walls;

said bottom wall attached to said stand top plate by cap screws;

a floor plate carried on two vertically extending pins in said bottom wall;

a floor plate shaft threadably engaged with said bottom wall and rotatably retained in said floor plate for vertical movement of said floor plate;

a floor plate riser secured to said floor plate;

a stationary jaw attached to said one of said frame side plates;

a side plate engaged with said stationary jaw;

a mobile jaw mounted to said other of said frame side plates;

a side plate engaged with said mobile jaw;

mounting means engaged with said other of said frame side plates and said mobile jaw to move said jaw towards and away from said stationary jaw;

a transversely extending carriage sight shaft extending through said frame side plates;

bearing means engaged with said sight shaft and said frame side plates for rotation of said shaft therein;

knob means on said sight shaft for rotation thereon;

sight carriage means carried on said shaft and movable there along to engage said sight for transverse movement in said dovetails, and slide leveler means carried in said stand top plate which are vertically adjustable.

2. A universal sight tool as defined in claim 1 in which said mobile jaw mounting means includes a pair of pins fixedly engaged in said other of said side plates and slidably engaged with said mobile jaw, a mobile jaw shaft threadably engaged with said other of said walls and rotatably engaged with said mobile jaw, and a knob affixed to said mobile jaw shaft for rotation thereof.

3. A universal sight tool as defined in claim 1 in which said stand, said frame, and said stationary and said mobile jaws have a black satin teflon finish thereon.

4. A universal sight tool as defined in claim 1 in which said sight carriage means is a block of rectangular configuration with a bottom wall and vertical side walls extending therefrom, which may selectively engage a sight for adjustment or removal and replacement.

5. A universal sight tool as defined in claim 1 in which said other frame side wall has an opening for insertion of a punch to drive a sight from a slide.

6. A universal sight tool as defined in claim 1 in which said frame top wall has a plurality of openings therethrough for insertion of drilling and tapping bushings.

7. A universal sight tool as defined in claim 1 in which said slide leveler means includes a threaded shaft carried in said frame top plate, a slide leveler knob affixed to said shaft, and a flat surface on said knob to engage a slide to be supported.

8. A universal sight tool as defined in claim 7, in which a V-block is provided carried on said flat surface to engage a barrel to be drilled and tapped.

9. A universal sight tool as defined in claim 8, in which an L-shaped clamp arm is provided attached to one of said stand side plates and extending over said V-block, a shaft threadably engaged with said clamp arm a knob affixed to said shaft for rotation thereof, and a tip carried by said shaft to engage a barrel carried by said V-block.

* * * * *